US007721944B2

(12) United States Patent
Patton

(10) Patent No.: US 7,721,944 B2
(45) Date of Patent: May 25, 2010

(54) WHIP

(76) Inventor: Robert Patton, 110 Larne Road, Ballycarry, Carrickfergus (GB) BT38 9JN ( * ) Notice: Subject to any disclaimer, the term of this patent is extended or adjusted under 35 U.S.C. 154(b) by 345 days.

(21) Appl. No.: 11/756,066

(22) Filed: May 31, 2007

(65) Prior Publication Data

US 2007/0284427 A1 Dec. 13, 2007

(30) Foreign Application Priority Data

Jun. 1, 2006 (GB) ..... 0610902.9

(51) Int. Cl.
*B68B 11/00* (2006.01)

(52) U.S. Cl. ..... 231/2.1

(58) Field of Classification Search ..... 231/2.1, 231/4, 5; 446/419, 421, 422
See application file for complete search history.

(56) References Cited

U.S. PATENT DOCUMENTS

| | | | | |
|---|---|---|---|---|
| 765,824 | A * | 7/1904 | Felker | 231/5 |
| 3,783,733 | A * | 1/1974 | Zirimis | 84/402 |
| 4,266,459 | A * | 5/1981 | Seregely | 84/402 |
| 4,750,670 | A | 6/1988 | Gabe | |

OTHER PUBLICATIONS

UK Search Report for GB0710383.1, completed Sep. 4, 2007.

* cited by examiner

*Primary Examiner*—Rob Swiatek
(74) *Attorney, Agent, or Firm*—Withrow & Terranova, P.L.L.C.

(57) ABSTRACT

A whip comprising a shaft having a first and second end, the shaft being arranged to provide a handle at the first end and a flapper located at the second end. The shaft comprises at least one planar fin located at the second end of the shaft, the fin being at least partially sheathed with the flapper.

11 Claims, 2 Drawing Sheets

WHIP

This application claims priority to UK 0610902.9, filed Jun. 1, 2006, the disclosure of which is hereby incorporated by reference in its entirety.

The present invention relates to a riding crop or whip.

The present invention provides a whip comprising a shaft having a first and second end, said shaft being arranged to provide a handle at said first end; and a flapper located at the second end;

wherein the shaft comprises at least one planar fin located at said second end of the shaft, said fin being at least partially sheathed with said flapper.

The arrangement is such that the fin does not twist, or substantially does not twist, about the longitudinal axis of the shaft during use of the whip. To this end, the connection between the fin and the shaft must be relatively firm. As a result, the flapper, or other covering that surrounds the fin during use, does not twist with respect to the shaft.

Typically, said shaft includes a spine and a spine covering formed around and extending along said spine toward the first end.

Preferably, the whip comprises a single fin extending around the second end of the shaft and, when present, said spine covering.

Alternatively, the whip comprises a plurality of fins extending around the second end of the shaft.

Typically, the spine is tapered toward said second end.

Preferably, the fin is formed integrally with the shaft or spine covering. Alternatively it may be fixed to the shaft/covering by any suitable means. The, or each, fin may be formed from plastics, or any other suitable material.

The covering, and optionally the fin(s), may be injection moulded onto the spine.

Typically, the covering is composed of a plastics or leather material.

Typically, the spine is composed of a flexible material.

For example, the spine may be composed of fibreglass.

Preferably, the whip further comprises a handle located over the first end of the spine.

Figure 1:
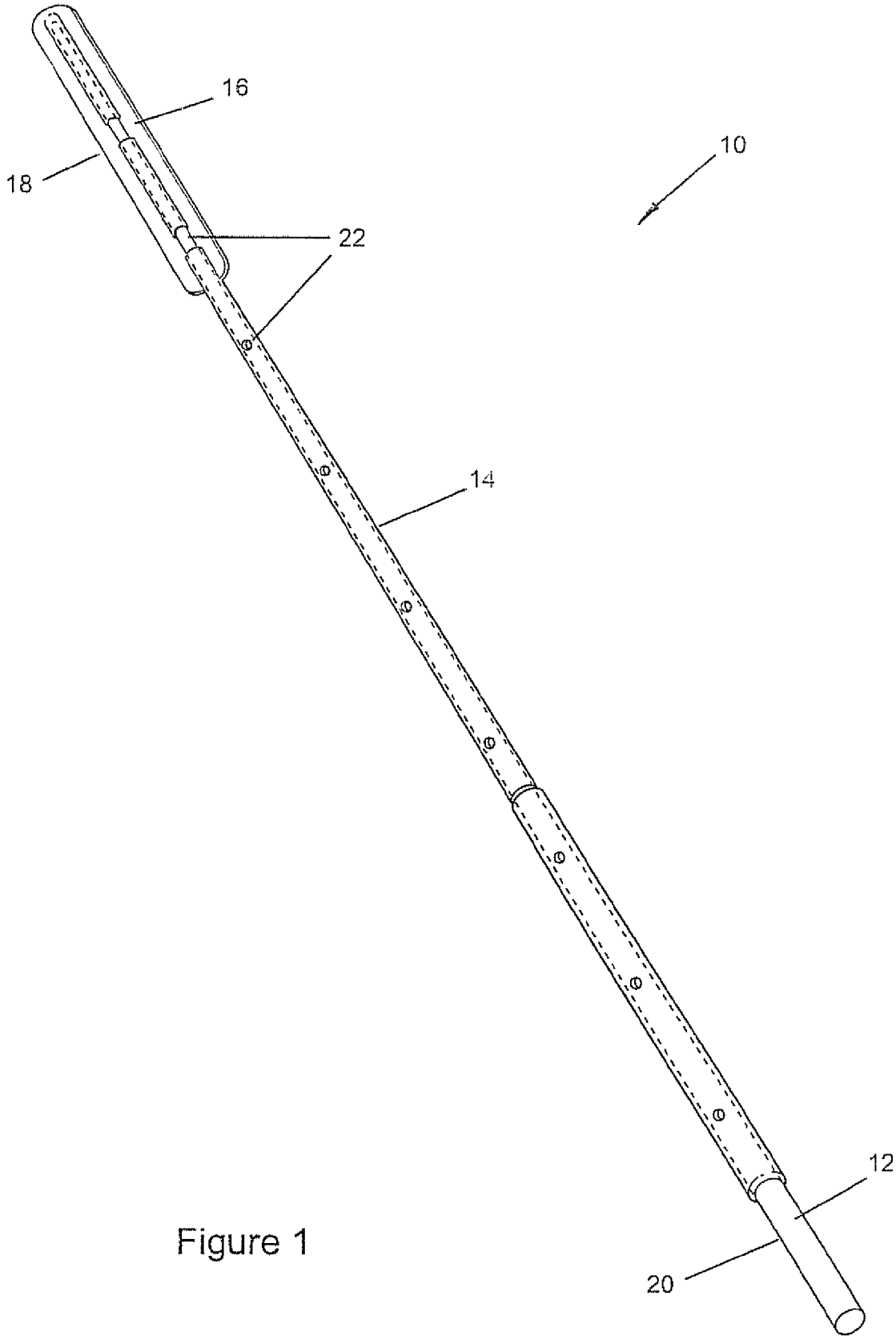
Figure 2:
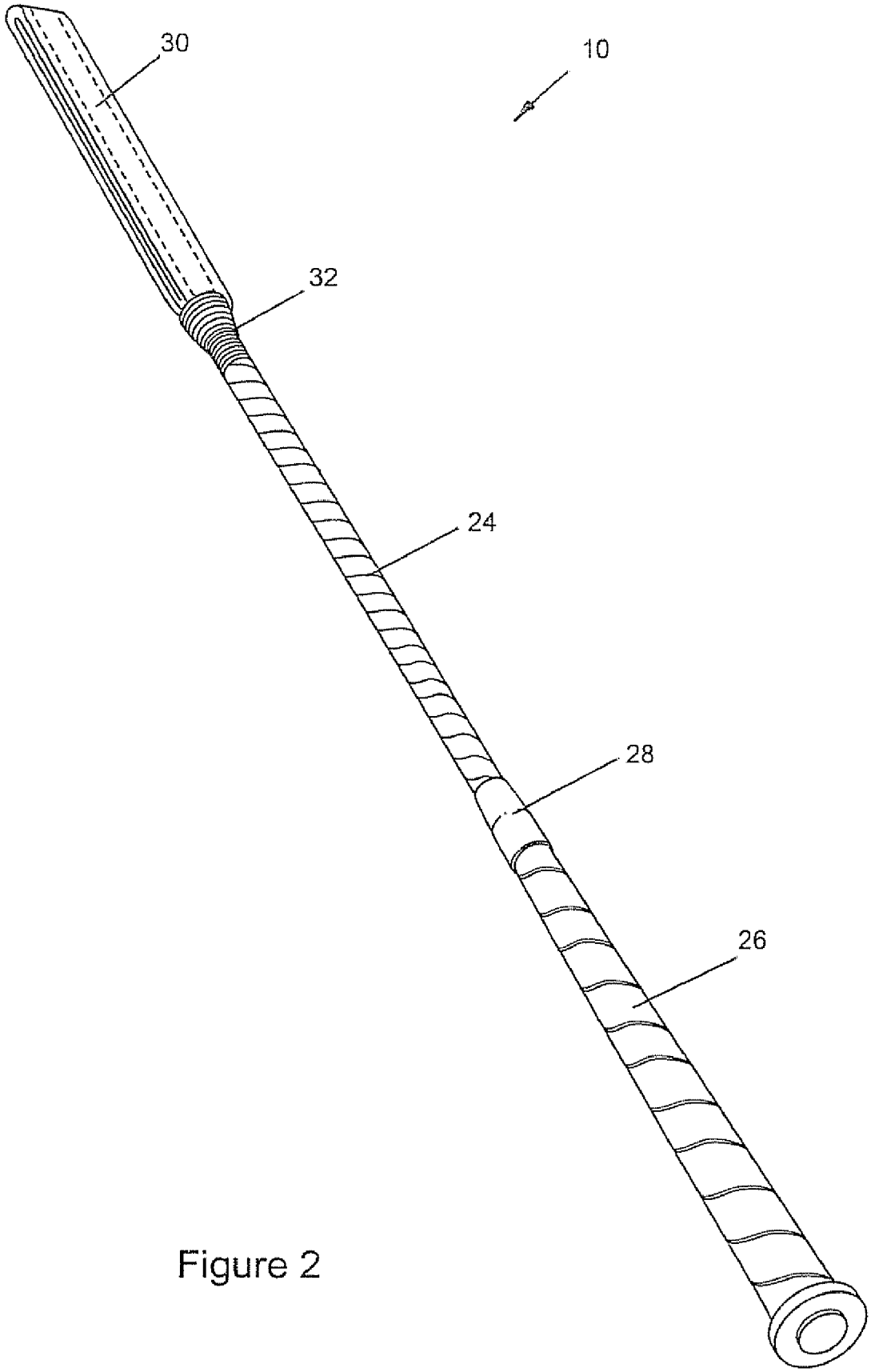

A preferred embodiment of the present invention will now be described, by way of example, with reference to the accompanying drawings, in which:

FIG. 1 illustrates a perspective view of a whip or crop according to a preferred embodiment of the present invention in an intermediate stage of production; and FIG. 2 illustrates a perspective view of a finished whip according to the preferred embodiment of the present invention.

Referring now to FIG. 1, there is illustrated a whip 10, comprising a shaft including a flexible, tapered spine 12. In the preferred embodiment, the spine 12 is composed of a composite material typically fibreglass. However it will be appreciated that the spine may be composed of any suitable material.

The shaft preferably comprises a plastic covering 14 formed around and extending along at least part of the length of the spine 12 such that the spine 12 protrudes from the covering 14 at its thicker end 20.

In the preferred embodiment, the plastic covering 14 is injection moulded onto the spine 12. In order to do so the spine 12 is held in place within a mould conforming to the outer shape of the covering by a series of holes or sprues (not shown). The liquid plastics material of the cover is injected into the mould and leaves voids 22 corresponding to the holes or sprues, disposed along the length of the spine 12 when the covered spine is removed from the mould.

Nonetheless, it will be apparent that the covering 14 may be provided on the spine by any suitable technique.

The covering 14 includes or is associated with a fin 16 located at the reduced diameter end 18 of the spine 10. The fin 16 is, conveniently, integrally formed with the covering 14 but may alternatively be fixed thereto by any suitable means. The fin 16 may be formed from any suitable material e.g. plastics or leather.

In the preferred embodiment, the fin 16 is a single continuous planar fin extending from and along the covering at the end of the spine 12 with the plane of the fin 16 intersecting the covering 14. However it will be appreciated that the fin may comprise a plurality of discrete generally co-planar fin portions, disposed along the reduced diameter end of the covering.

Referring now to FIG. 2, in the preferred embodiment, a middle portion 24 of the spine 10 is covered with a material, for example leather or plastics, wound in a spiral. However it will be appreciated that this portion may be covered in any manner with any suitable material.

A handle 26 is located over the thicker end 20 of the spine 12 and extends over the covering 14 to the middle portion 24 of the spine 12.

In the preferred embodiment, a rubber sleeve 28 conceals the point at which the handle 26 and the middle portion 24 meet. However it will be appreciated that the sleeve may be composed of any suitable material.

A flapper 30, or other end cover, is provided at the reduced diameter end 18 of the spine 10. In the preferred embodiment, the flapper 30, or popper, is composed of a single piece of padded material, e.g. padded leather, bent on itself to form a loop. The loop is stitched along each side to form a sheath like flapper. The flapper 30, is preferably but not necessarily padded and may be formed from any other suitable material e.g. leatherette or nylon.

The flapper 30 is located over the fin 16 so that flapper does not twist on the whip spine 10 thereby avoiding the need for a very tight fitting flapper and so providing a more cushioned yet secured flapper than where a flapper is tightly fitted over a cylindrical shaft. The fin 16 also provides a broader base for the flapper 30 than would a cylindrical spine, and this spreads the impact force during use.

Once fitted, each free end of the loop of material forming the flapper is secured to the end of the spine by means of a string type binding 32.

It will be appreciated that the flapper 30 need not necessarily take the form of a loop and may comprise one or more pieces of a flexible material, for example leather, plastics, rubber or the like and may be of any suitable form.

It will also be seen that the flapper 30 need not completely sheath the fin 16 and instead the flapper may simply extend around only the outer edges of the fins. In this case, the planar surfaces of the fin 16 are preferably covered with a separate cushioning material. The flapper may be located around the end 18 including the fin 16 and any cushioning material.

The present invention is not limited to the embodiment described herein, which may be amended or modified without departing from the scope of the present invention.

The invention claimed is:

1. A whip comprising:

a shaft having first and second ends and a spine tapered toward said second end, said shaft being arranged to provide a handle at said first end; and a flapper located at the second end, wherein the shaft comprises at least one planar fin located at said second end of the shaft, said at least one planar fin being at least partially sheathed with said flapper.

2. The whip according to claim 1 wherein said shaft further comprises a spine covering formed around and extending along said spine toward the first end.

3. The whip according to claim 2 wherein the whip further comprises a single fin, where a plane of the single fin intersects the spine covering.

4. The whip according to claim 2 wherein the spine covering is composed of a plastic or leather material.

5. The whip according to claim 2 wherein the spine covering is injected molded onto the spine.

6. The whip according to claim 1 wherein the whip further comprises a single fin.

7. The whip according to claim 1 wherein the at least one planar fin is formed integrally with the shaft.

8. The whip according to claim 1 wherein the at least one planar fin is injection molded onto the spine.

9. The whip according to claim 1 wherein the at least one planar fin is formed from plastic.

10. The whip according to claim 1 wherein the spine is composed of a flexible material.

11. The whip according to claim 1 wherein the spine is composed of fiberglass.

* * * * *